US006923707B2

(12) United States Patent
Dancer

(10) Patent No.: US 6,923,707 B2
(45) Date of Patent: Aug. 2, 2005

(54) DOLL

(76) Inventor: Jacqui Dancer, 14 Lombard Street, Glebe (GB), NSW 2037

( * ) Notice: Subject to any disclaimer, the term of this patent is extended or adjusted under 35 U.S.C. 154(b) by 0 days.

(21) Appl. No.: 10/276,621

(22) PCT Filed: May 14, 2001

(86) PCT No.: PCT/AU01/00548

§ 371 (c)(1),
(2), (4) Date: Apr. 28, 2003

(87) PCT Pub. No.: WO01/87443

PCT Pub. Date: Nov. 22, 2001

(65) Prior Publication Data

US 2003/0162472 A1 Aug. 28, 2003

(30) Foreign Application Priority Data

May 18, 2000 (AU) ..... PQ8824

(51) Int. Cl.[7] ..... A63H 13/02; A63H 3/38

(52) U.S. Cl. ..... 446/337; 446/339; 446/392; 446/395

(58) Field of Search ..... 446/337, 27, 339, 446/100, 97, 99, 391, 394, 395, 486, 487, 300, 338, 341, 392, 393, 385, 343, 344

(56) References Cited

U.S. PATENT DOCUMENTS

| | | | | | |
|---|---|---|---|---|---|
| 1,340,512 | A | * | 5/1920 | Wild | 446/100 |
| 2,019,516 | A | * | 11/1935 | Weinberg | 446/100 |
| 3,621,606 | A | * | 11/1971 | Potrzuski | 446/297 |
| 3,839,821 | A | * | 10/1974 | Forsman | 446/28 |
| 4,122,628 | A | * | 10/1978 | Crowell et al. | 446/100 |
| 4,409,754 | A | * | 10/1983 | Moreau | 446/392 |
| 4,648,851 | A | | 3/1987 | Rosenberg | |
| 4,698,927 | A | * | 10/1987 | Yoshiro | 40/1.6 |
| 4,767,374 | A | * | 8/1988 | Yang | 446/301 |
| 5,178,574 | A | | 1/1993 | Evoy | |
| 5,348,510 | A | | 9/1994 | DuPont et al. | |
| 5,376,040 | A | * | 12/1994 | Hickman et al. | 446/329 |
| 5,800,242 | A | * | 9/1998 | Clokey | 446/374 |
| 6,186,859 | B1 | * | 2/2001 | Hickman et al. | 446/329 |
| 6,280,283 | B1 | * | 8/2001 | Sisler | 446/100 |

FOREIGN PATENT DOCUMENTS

| | | | |
|---|---|---|---|
| DE | 3003558 | A | 8/1981 |
| GB | 488434 | A | 7/1938 |
| GB | 2252057 | * | 7/1992 |

* cited by examiner

*Primary Examiner*—Derris H. Banks
*Assistant Examiner*—Faye Francis
(74) *Attorney, Agent, or Firm*—Timothy J. Keefer; Seyfarth Shaw LLP

(57) ABSTRACT

A doll including a head, a torso and limbs in the form of arms and legs. The doll includes a face having particular facial elements such as eyes, a mouth and a pair of antennae. Each eye includes a eye rim. The eye rim is formed from an elongate member of an endless loop configuration. The eye rim is stitch the face at four locations and is constructed from a core material about which a decorative liner is disposed. The core material may be a light gauge rod of a plastically deformable material such as wire. Thus the eye rims and other facial features can be manipulated by hand to vary their shapes and thus the facial expression of the doll.

3 Claims, 3 Drawing Sheets

DOLL

CROSS REFERENCE TO RELATED APPLICATION

This application claims the priority of Australian patent application serial No. PQ 8824, filed on May 18, 2000.

FIELD OF THE INVENTION

The present invention relates generally to a doll and relates particularly, though not exclusively, to a doll including facial features which can be manipulated to vary its expression.

BACKGROUND OF THE INVENTION

U.S. Pat. No. 5,215,493 describes a stuffed toy in the configuration of a pickle. The stuffed toy has changeable facial expressions in relation to the eyes and mouth. The eyes and mouth are formed from a stud which pierces the stuffed toy and is held in position via a washer, The remainder of the eyes or mouth are formed from a vinyl panel cut out in a crescent-shape and rotationally mounted to the stuff toy via the stud and washer arrangement. The expression of the stuffed toy may be changed by rotating the eyes and/or mouth panels which are made of a stiff material such an vinyl.

U.S. Pat. Nos. 5,376,040 and 5,800,242 also disclose dolls or toys including facial features which can be manipulated to, for example, selectively achieve a wide variety of moods or expressions. U.S. Pat. No. 5,376,040 describes a doll including a mouth in the form of an elastic band which is resilient wherein the mouth is temporarily deformed using a pair of fingers and thereafter the mouth returns to its undeformed configuration. U.S. Pat. No. 5,800,242 describes a toy including a skeleton structure of a plastically deformable material, the reinforcing frame of the skeleton structure being embedded in the material such as the rubber moulding.

SUMMARY OF THE INVENTION

According to the present invention there is provided a doll comprising a face having one or more facial elements each being representative of a facial feature and being elongate and of an endless loop configuration which is stitched or otherwise adhered at at least two opposite and distant locations to an exposed surface of the face, each of the facial elements being constructed of a plastically deformable material which can be manipulated whereupon it retains its manipulated shape to change the shape of the facial feature and thus the facial expression of the doll.

Preferably each of the facial elements includes an elongate member of an endless loop configuration. More preferably the elongate member is in the form of the facial feature of a mouth or an eye's rim.

Preferably the elongate member of the facial element includes a relatively light gauge rod of a plastically deformable material such as a wire or plastic material. More preferably the light gauge rod is a core material about which a decorative liner is disposed.

Generally the face is fabricated from a pliable fabric such as velour.

BRIEF DESCRIPTION OF THE DRAWINGS

In order to achieve a better understanding of the nature of the present invention a preferred embodiment of a doll will now be described, by way of example only, with reference to the accompanying drawings in which.

DETAILED DESCRIPTION OF THE PREFERRED EMBODIMENT

Figure 1:
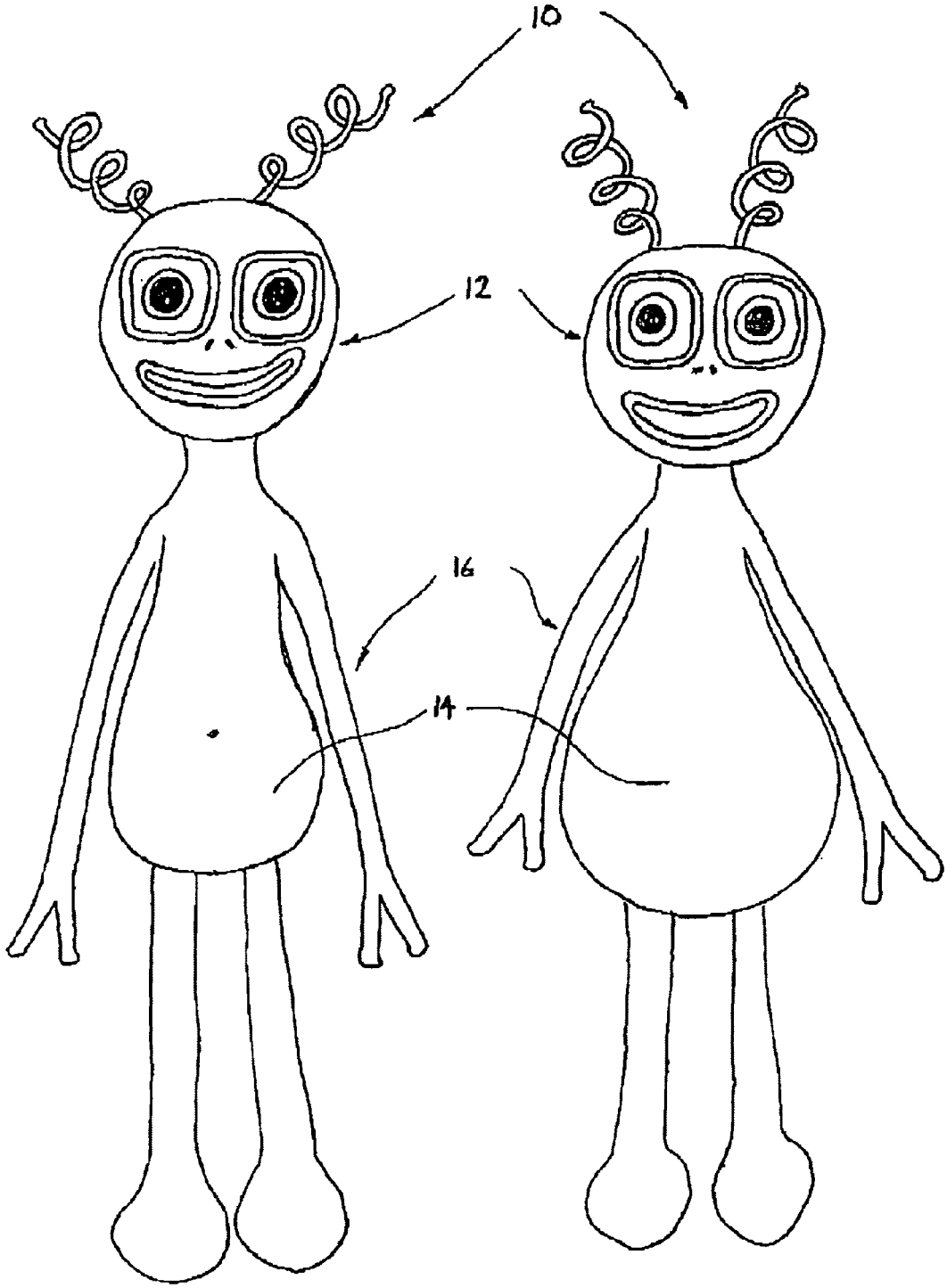
FIG. 1 is a front view of two variants of a doll.

As shown in FIG. 1 there are two forms of a doll both designated generally as 10 including a head 12, a torso 14 and limbs 16 in the form of arms and legs. The doll 10 of this embodiment is fabricated as a stuffed doll and generally represents a distinctive looking alien.

Figure 2:
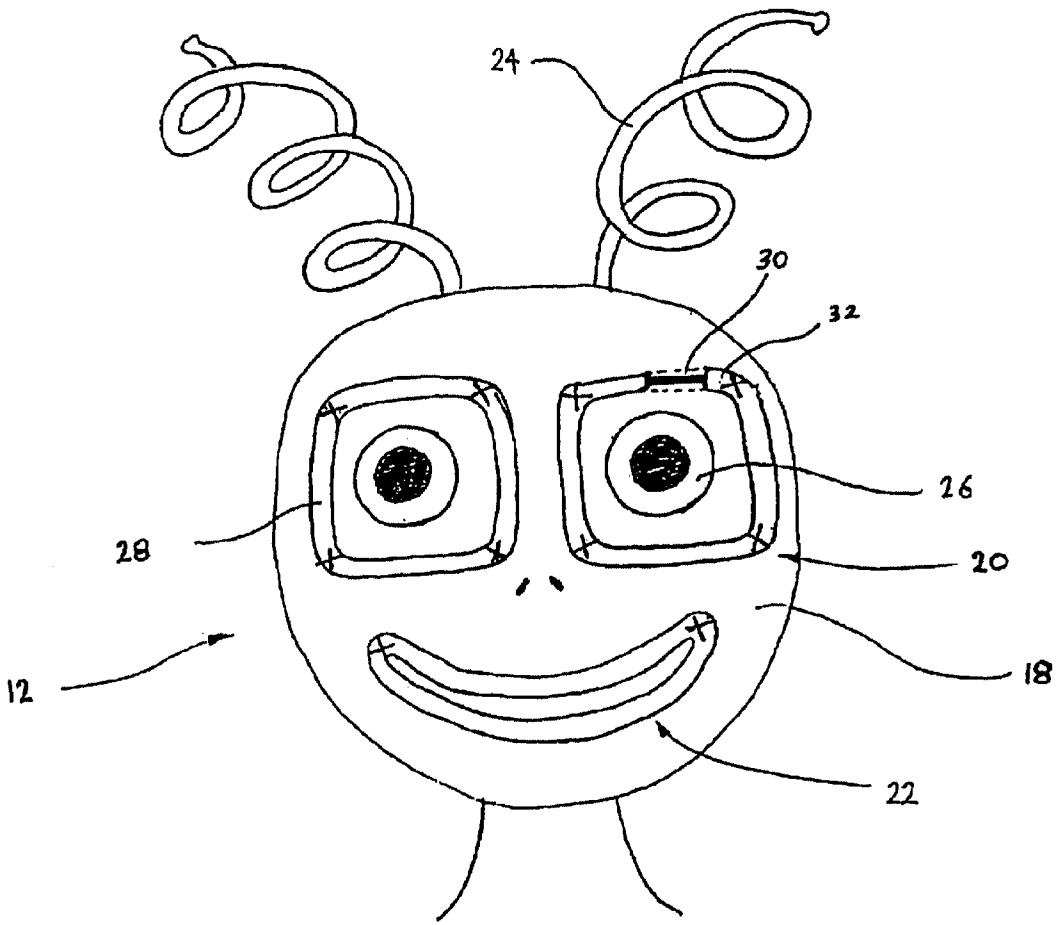
FIG. 2 is an enlarged view of a face of one of the dolls of FIG. 1.
Figure 3:
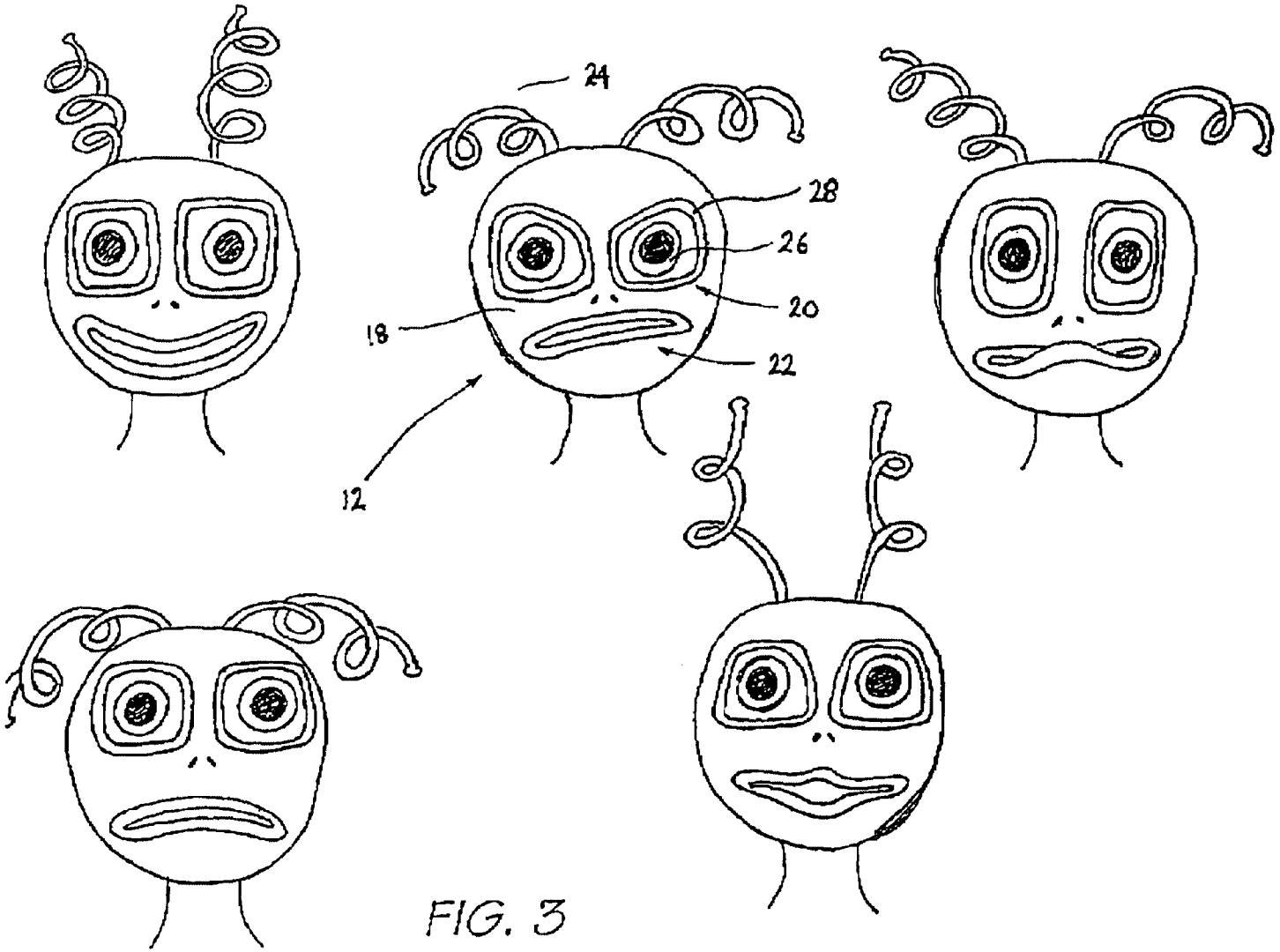
FIG. 3 is the face of FIG. 2 shown with various facial expressions.

As beat shown in FIGS. 2 and 3 the head 12 of the doll 10 includes a face 18 having particular facial elements. In this embodiment the facial elements include its eyes shown generally as 20 and a mouth 22. Also shown is a pair of antenna such as 24. Thus, each of the facial elements is representative of a facial feature of the doll 10.

Each of the eyes such as 20 includes an eyeball 26 which is in the form of a button fixed to the head 12, and an eye rim 28. The eye rim 28 is formed from an elongate member of an endless loop configuration. The eye rim 28 is in this example stitched to the face 18 at four (4) spaced apart location. The eye rim 28 is constructed from a core material 30 about which a decorative liner 32 is disposed. The core material is in this example a relatively light gauge rod of a plastically deformable material such as a wire or plastic material. The decorative liner is of a satin or other appropriate decorative fabric.

The eye rims such as 28 can thus be manipulated by hand to vary the shape of this particular facial feature and thus the facial expression of the doll 10. The plastically deformable material from which the eye rims 28 are constructed together with their spaced apart fixing to the face 18 permit this varied manipulation of the facial feature.

The mouth 22 is similarly constructed of an elongate member of an endless loop configuration. The mouth 22 is initially shaped in its curved configuration of FIG. 2 and stitched to the face 18 at two (2) opposite and distant locations. Thus, the mouth 22 which is also constructed from the plastically deformable material can be manipulated into a variety of shapes and forms indicative of a particular facial expression.

The alien doll 10 of this embodiment includes the pair of antenna such as 24 fixed to and protruding from the head 12. Each of the antenna such as 24 is formed of the same material as the mouth 22 and eye rims 28. However, the antenna 24 are anchored or otherwise fixed to the head 12 at one end only with a free end allowing the antenna 24 to be manipulated into a variety of positions. Additionally, the antenna 24 may be twisted, spiralled or straightened depending on the general "mood" or facial expression which is to be conveyed by the doll 10.

The stuffed doll 10 of this embodiment is lined in a soft fabric such as velour. This soft and pliable fabric tends to "move" together with the facial features so as to increase the range of configurations in which the facial features may be manipulated. Particular features, such as the mouth 22, may also be manipulated 3-dimensionally with, for example, a lower lip of the mouth being raised outwardly and upwardly to overlap the upper lip. Otherwise, the face la of the doll 10 can be manipulated into a variety of shapes and corresponding facial expressions. FIG. 3 indicates some of the possible configurations and expressions of the doll 10 of this embodiment of the invention.

Now that a preferred embodiment of the present invention has been described in some detail, it will be apparent to those skilled in the art that the doll has at least the following advantages:

the facial expression of the doll can be varied by manipulating and thus deforming one or more of its facial features;

(i) the facial expression of the doll can be varied by manipulating and thus deforming one or more of its facial features;

(ii) the doll is relatively simple in construction where, for example, the facial features are merely fixed to the face of the doll; and (iii) the doll is relatively versatile and adaptable for use by both children and adults as a toy for stress relief.

Those skilled in the art will appreciate that the invention described herein is susceptible to variations and modifications other than those specifically described. For example, the facial features may be constructed of practically any material which can be plastically deformed to vary and retain its shape, such as a deformable plastic material possibly in the form of a foam. The facial feature may be fixed to the face via an adhesive or fastener although the stitching described is preferable.

All such variations and modifications are to be considered within the scope of the present invention the nature of which is to be determined from the foregoing description.

It is to be understood that, if any prior art information is referred to herein, such reference does not constitute an admission that the information forms a part of the common general knowledge in the art, in Australia or any other country.

What is claimed is:

1. A doll comprising a face having facial elements, each of the facial elements being representative of a facial feature of an eye and a mouth and being elongated and of an endless loop configuration which is stitched or otherwise adhered at at least two opposite and distant locations to an exposed surface of the face, each of the facial elements being constructed of a plastically deformed material which is manipulable from a first position to a second position in three-dimensional space, wherein, upon manipulation, the facial element remains in the second position, thereby retaining the changed shape of the facial feature and thus the facial expression of the doll.

2. A doll as defined in claim 1 wherein the elongated member of facial elements include a relatively light gauge rod of a plastically deformable material.

3. A doll as defined in claim 2 further including a decorative liner which is disposed about the light gauge rod.

* * * * *